US007775019B2

(12) United States Patent
Haak et al.

(10) Patent No.: US 7,775,019 B2
(45) Date of Patent: Aug. 17, 2010

(54) AUTOMATED OPERATION APPLICATION MODULE, IN PARTICULAR FOR A PACKAGING MACHINE

(75) Inventors: Juergen Haak, Stuttgart (DE); Tobias Greif, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 78 days.

(21) Appl. No.: 11/912,222

(22) PCT Filed: Apr. 5, 2006

(86) PCT No.: PCT/EP2006/061347

§ 371 (c)(1),
(2), (4) Date: Apr. 21, 2008

(87) PCT Pub. No.: WO2006/111473

PCT Pub. Date: Oct. 26, 2006

(65) Prior Publication Data

US 2009/0217623 A1 Sep. 3, 2009

(30) Foreign Application Priority Data

Apr. 20, 2005 (DE) ..... 10 2005 018 407

(51) Int. Cl.
*B65B 41/12* (2006.01)

(52) U.S. Cl. ..... 53/389.2; 53/135.3; 53/51; 53/393

(58) Field of Classification Search ..... 53/51, 53/52, 135.2, 135.3, DIG. 2, 128.1, 135.1, 53/416, 389.1, 389.2, 389.5
See application file for complete search history.

(56) References Cited

U.S. PATENT DOCUMENTS 3,374,602 A * 3/1968 Hamilton ..... 53/51
3,432,087 A * 3/1969 Costello ..... 383/103
3,992,854 A * 11/1976 Howell et al. ..... 53/412
4,000,846 A * 1/1977 Gilbert ..... 383/103
4,083,737 A * 4/1978 Foote et al. ..... 156/73.1

(Continued)

FOREIGN PATENT DOCUMENTS

DE 19825064 A1 12/1999

(Continued)

*Primary Examiner*—Paul R Durand
(74) *Attorney, Agent, or Firm*—Ronald E. Greigg

(57) ABSTRACT

An automated operation application module for a packaging machine comprises a frame, a suspension joined to the frame for rolls of packaging material, and a pre-unwinding unit for supplying the packaging material to the film storage unit. The application module has a film storage unit joined to the frame, a sealing station joined to the frame, a film pre-drawing unit joined to the frame for supplying the packaging material to the sealing station, and a film-forwarding unit joined to the frame for forwarding the processed packaging material to a packaging machine.

20 Claims, 3 Drawing Sheets

U.S. PATENT DOCUMENTS 4,122,993 A * 10/1978 Glas ..... 383/103
4,262,470 A * 4/1981 Reuter et al. ..... 53/202
4,548,018 A * 10/1985 Wojnicki ..... 53/51
4,566,250 A * 1/1986 Matsumura et al. ..... 53/500
4,568,321 A 2/1986 Gaubert
4,707,965 A * 11/1987 Becker ..... 53/410
4,995,936 A * 2/1991 Cohn ..... 156/504
5,038,550 A * 8/1991 Wirsig et al. ..... 53/451
5,067,307 A * 11/1991 Francioni et al. ..... 53/450
5,117,608 A * 6/1992 Nease et al. ..... 53/51
5,178,023 A * 1/1993 Domke et al. ..... 73/865.9
5,277,741 A * 1/1994 Kramer ..... 156/353
5,445,870 A * 8/1995 Buchner et al. ..... 428/214
5,715,656 A * 2/1998 Pearce ..... 53/451
6,041,574 A * 3/2000 Bennett ..... 53/411
6,079,188 A * 6/2000 Katayama et al. ..... 53/451
6,182,426 B1 2/2001 Pritchard
6,213,645 B1 * 4/2001 Beer ..... 383/211
6,722,102 B1 * 4/2004 Pape et al. ..... 53/410
6,826,892 B2 * 12/2004 Basque et al. ..... 53/410
7,082,737 B2 * 8/2006 Van Rens et al. ..... 53/64
7,328,543 B2 * 2/2008 Hoffman et al. ..... 53/128.1
7,415,809 B2 * 8/2008 Taylor ..... 53/167
2001/0000089 A1 4/2001 Pritchard
2003/0177739 A1 9/2003 Lewis, Jr. et al.
2004/0134165 A1 7/2004 Basque et al.
2004/0159574 A1 8/2004 Lewis, Jr. et al.

FOREIGN PATENT DOCUMENTS

DE 19910485 A1 9/2000

* cited by examiner

AUTOMATED OPERATION APPLICATION MODULE, IN PARTICULAR FOR A PACKAGING MACHINE

CROSS-REFERENCE TO RELATED APPLICATION

This application is a 35 USC 371 application of PCT/EP 2006/061347 filed on Apr. 5, 2006.

BACKGROUND OF THE INVENTION

1. Field of the Invention

The invention is based on an independently functioning applications module, in particular for a packaging machine.

2. Description of the Prior Art

Integrated built-in/fixed modules in intermittent bag-making machines with extensive mechanical and electrical interfaces are known, which for instance seal internal coffee degassing valves into films from which the bag to be filled is also made on the same machine. Manual workstations are also known.

SUMMARY AND ADVANTAGES OF THE INVENTION

Applying internal coffee degassing valves is done without complicated mechanical and electrical intervention into a bag-making machine or packaging system or sheet of film. The mode of operation of the downstream packaging machine may be intermittent or continuous. By decoupling the independently functioning applications module from the actual packaging machine, such as a bag-making machine, high capacities can be attained, on the order for instance of 120 valve applications per minute. The linear projection is reduced to a minimum, since there are only a few, simple interfaces with downstream machines. For this reason, retrofitting already-installed packaging lines that do not have degassing valves is less risky, and the conversion time on-site is shortened, compared to the integrated version. With this module, even high-speed bag-making machines with continuous film pre-drawing are capable of processing internal coffee degassing valves. The independently functioning applications module of the invention moreover serves to decouple the upstream and downstream processes (intermittent or continuous). It has a separate controller. The downstream packaging machine, such as a bag-making machine, may be from an arbitrary manufacturer, which lessens the effort and expense involved in planning. A fully-tested module can be furnished when a retrofit is to be done. Moreover, the independently functioning applications module can easily be used for other variants/applications, such as zippers or ziplock closures or reclosure means (that are to be glued or sealed onto films).

BRIEF DESCRIPTION OF THE DRAWINGS

Further advantages and advantageous refinements of the independently functioning applications module of the invention will become apparent from the description contained herein below, taken in conjunction with the drawings, in which.

DESCRIPTION OF THE PREFERRED EMBODIMENT

Figure 1:
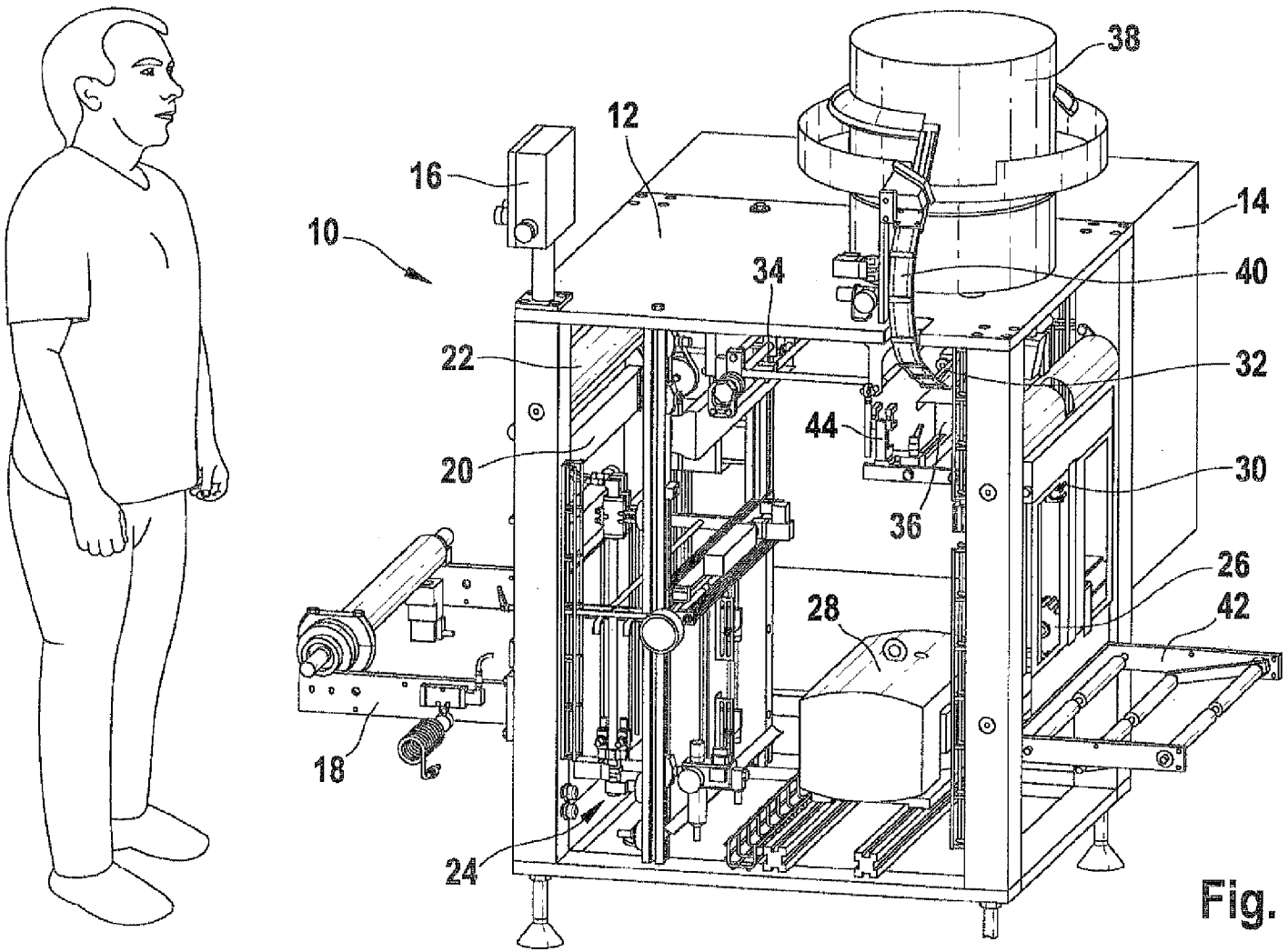
FIG. 1 is a perspective view of the independently functioning applications module of the invention, without showing the packaging material.

An independently functioning applications module 10 comprises a frame 12 with a screwed-on control box 14, and an integrated user input and display terminal 16. A suspension bracket 18 for rolls of packaging material and a cutting and gluing table 20 are decoupled from the existing packaging system and secured to the frame 12. A pre-unwinding unit 22, which introduces a packaging material 13, such as a film, into a film storage unit 24 continuously, and a servo motor-driven vacuum film pre-drawing unit 26, which intermittently draws the packaging material 13 from the film storage unit 24, form the packaging material pre-drawing unit. For the precise placement of the item to be sealed in, such as a valve, the film pre-drawing unit 26 uses a printed mark controller 30. Between the film storage unit 24 and the vacuum film pre-drawing unit 26, a servo motor-driven sealing station 32 and a film notching station 34 are accommodated. For reducing the process time, the sealing station 32 operates by the ultrasound method, by means of an ultrasound sealer 36. An electromagnetic vibrator conveyor 38 for sorting and supplying the items, not shown, to be sealed in to the sealing station 32 is placed on the coverplate of the frame 12. The exchange of signals with the downstream machine is done via potential-free contacts. The items to be sealed in are delivered to the sealing station 32 by the vibrator conveyor 38 via a supply channel 40. The sealing station 32 is preceded by a web edge controller 44. The film 13, now provided with the sealed-in items, leaves the independently functioning applications module 10 via a film-forwarding unit 42, which is equipped for instance with a rocker for maintaining the web tension. A separate controller for the applications module 10 is accommodated in the control box 14 that is connected to the frame 12.

Figure 2:
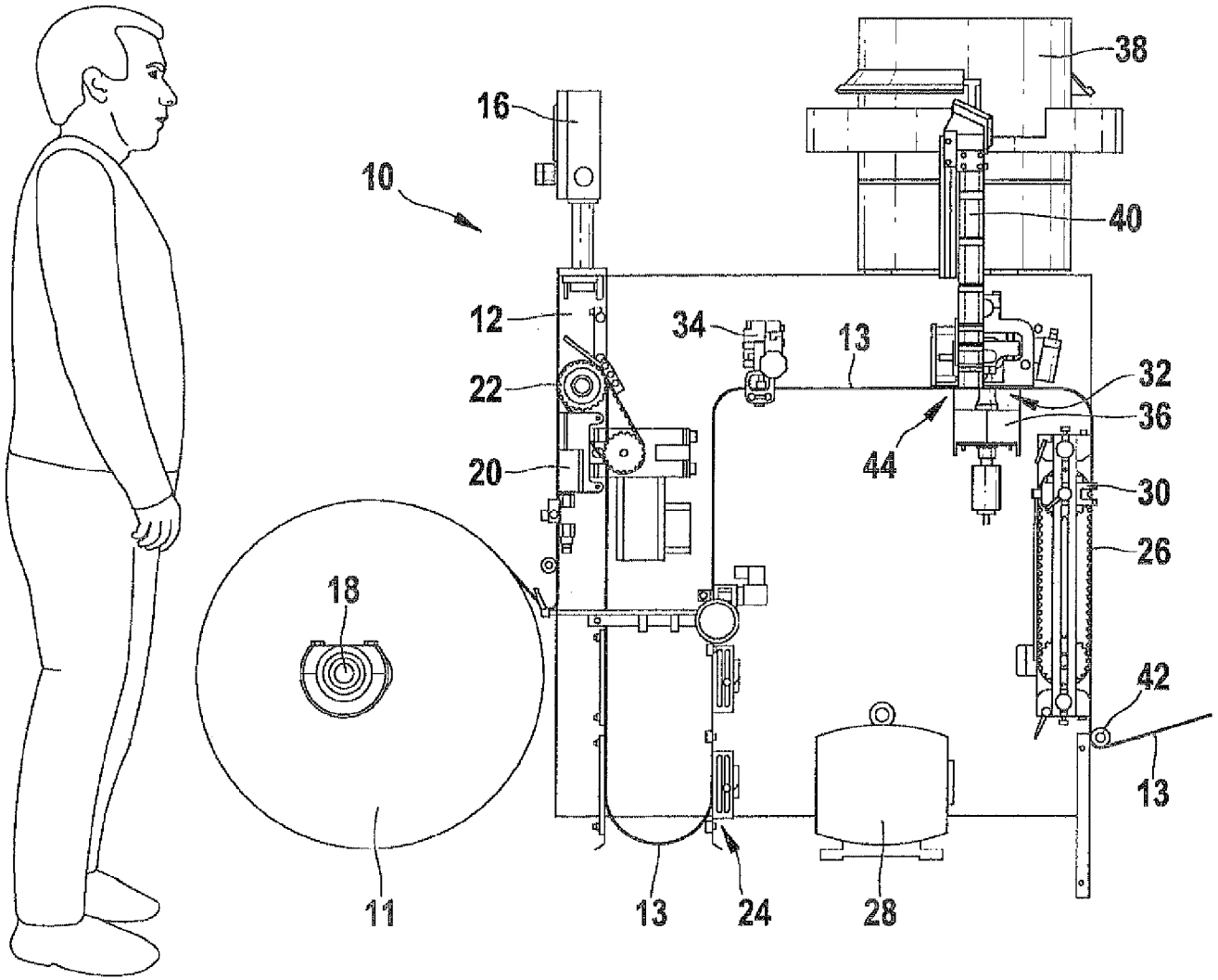
FIG. 2 is a side view with film, but without the frame.
Figure 3:
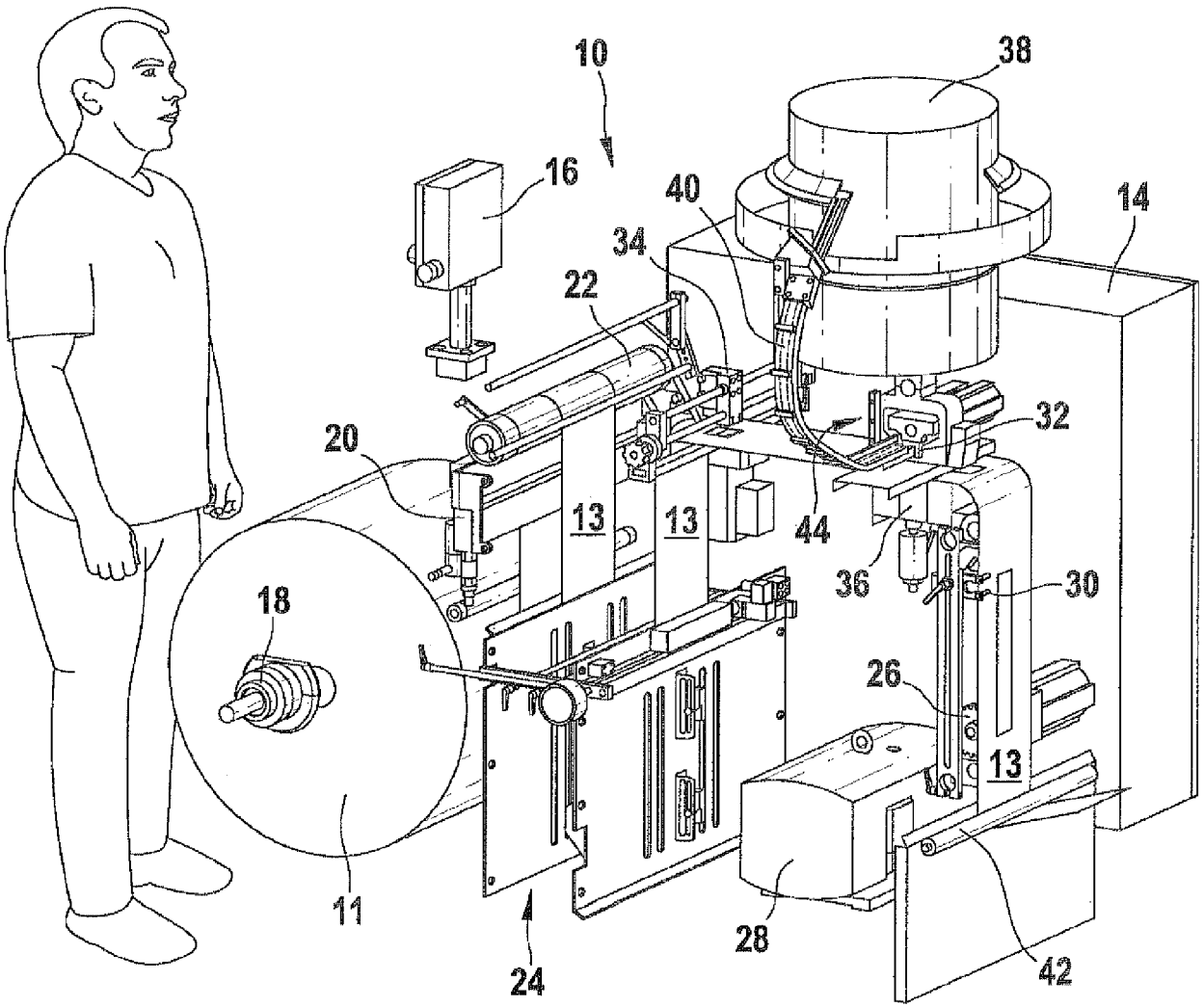
FIG. 3 shows an isometric view of the arrangement shown in FIG. 2.

The independently functioning applications module 10 serves in particular to connect internally located coffee degassing valves to a packaging material 13, such as a film. These valves are supplied to the applications module 10 via the vibrator conveyor 38. The packaging material 13, provided with the valves, can then be supplied to further packaging machines, such as bag-making machines, for producing and filling a bag of coffee. The provision of an independently functioning applications module 10 simplifies the retrofitting of existing packaging machines and serves to decouple the upstream and downstream processes. As can be seen from FIGS. 2 and 3, the roll 11 of packaging material is located in the suspension means 18 for rolls of packaging material. The film 13 passes over deflection rollers to reach the cutting and gluing table 20. If the end of a roll 11 of packaging material is detected, the cutting and gluing table 20 serves to connect the web of film that is running out to the beginning of a new web of film of a new roll 11 of packaging material. The film 13 is delivered to the film storage unit 24 via the pre-unwinding unit 22. According to the invention, for high-capacity applications modules 10, a so-called air-bag film storage unit is suitable. This so called air-bag film storage unit compensates for different lengths of packaging material that can occur as a result of different processing speeds upstream and downstream from the film storage means 24. An air stream inflates, or pushes against the packaging material located in the film storage means 24 and puts the packaging material under tension, thus contributing to the processing safety by keeping the packaging material under tension and taking up any slack which may develop because of the above mentioned different processing speeds. This type of film storage unit, known per se, moreover includes regulation, done for instance via a photoelectric barrier, and a vacuum brake for maintaining the desired film tension. A shunt serves the purpose of cleanly guiding the film. By means of the film storage unit 24 operating on an air-bag principle as described above, very short advancement times can be attained. In principle, however, still other types of known film storage units 24 are conceivable. From the film storage unit 24, the film 13 reaches the film notching station 34. The film 13 is perforated at the point where the valve will later be sealed to the film in the sealing station 32. Next, the film is delivered intermittently to the sealing station 32. Via the vibrator conveyor 38 and the supply channel 40, the valves reach the sealing station 32. By means of a positioning device, the valve is put in the desired sealing position, above the notching point in the film 13. The valve is delivered to a sealing die, which is moved in the vertical direction into a sealing position. In the sealing process, thermal methods are used, for instance, which generate heat either conventionally or by using ultrasound. In the applications module 10 shown, an ultrasound sealer 36 is used according to the invention; it makes very short welding cycles possible. In principle, however, still other methods are conceivable. The vacuum film pre-drawing unit 26 is driven by a servo motor, for instance, and intermittently draws the film 13 from the film storage unit 24. The intermittent film drawing could, however, be generated in some other way than by means of a vacuum. The vacuum pump 28, which is also a component of the applications module, makes the required vacuum available.

As the items to be scaled in, other items besides valves that may be applied instead are reclosure means, zippers or ziplock closures, or the like that are sealed/glued, or arbitrary other items.

The foregoing relates to a preferred exemplary embodiment of the invention, it being understood that other variants and embodiments thereof are possible within the spirit and scope of the invention, the latter being defined by the appended claims.

The invention claimed is:

1. An independently functioning applications module for a packaging machine, the module comprising: a frame (12);

a suspension means (18) for rolls of packaging material connected to the frame;

a film storage unit (24) connected to the frame;

a pre-unwinding unit (22) for supplying packaging material to the film storage unit;

a sealing station (32) connected to the frame;

a vacuum film pre-drawing unit (26), connected to the frame, for supplying the packaging material to the sealing station (32);

a film-forwarding unit, connected to the frame, for forwarding the processed packaging material to a packaging machine; and a vacuum pump (18) for furnishing the requisite vacuum for the vacuum film pre-drawing unit (26).

2. The apparatus as defined by claim 1, wherein the film storage unit includes means which compensates for differences in processing speeds upstream and downstream from the film storage unit via air pressure applied against the packaging material.

3. The apparatus as defined by claim 1, wherein the sealing station comprises an ultrasound sealer.

4. The apparatus as defined by claim 1, further comprising a user input and display terminal connected to the frame.

5. The apparatus as defined by claim 1, further comprising a printed mark controller connected to the frame, for controlling the film pre-drawing unit.

6. The apparatus as defined by claim 1, further comprising a cutting and gluing table disposed in the frame.

7. The apparatus as defined by claim 6, further comprising a film notching station connected to the frame.

8. The apparatus as defined by claim 6, further comprising a vibrator conveyor connected to the frame for supplying items to be sealed in to the sealing station.

9. The apparatus as defined by claim 6, wherein the film storage unit includes means which compensates for differences in processing speeds upstream and downstream from the film storage unit via air pressure applied against the packaging material.

10. The apparatus as defined by claim 6, wherein the sealing station comprises an ultrasound sealer.

11. The apparatus as defined by claim 6, further comprising a user input and display terminal connected to the frame.

12. The apparatus as defined by claim 1, further comprising a film notching station connected to the frame.

13. The apparatus as defined by claim 12, further comprising a vibrator conveyor connected to the frame for supplying items to be sealed in to the sealing station.

14. The apparatus as defined by claim 12, wherein the film storage unit includes means which compensates for differences in processing speeds upstream and downstream from the film storage unit via air pressure applied against the packaging material.

15. The apparatus as defined by claim 12, wherein the sealing station comprises an ultrasound sealer.

16. The apparatus as defined by claim 12, further comprising a user input and display terminal connected to the frame.

17. The apparatus as defined by claim 1, further comprising a vibrator conveyor connected to the frame for supplying items to be sealed in to the sealing station.

18. The apparatus as defined by claim 17, wherein the film storage unit includes means which compensates for differences in processing speeds upstream and downstream from the film storage unit via air pressure applied against the packaging material.

19. The apparatus as defined by claim 17, wherein the sealing station comprises an ultrasound sealer.

20. The apparatus as defined by claim 17, further comprising a supply channel is connecting the vibrator conveyor to the sealing station.

* * * * *